United States Patent [19]

Strzelecki

[11] Patent Number: 4,498,143

[45] Date of Patent: Feb. 5, 1985

[54] METHOD OF AND APPARATUS FOR FORMING IDEOGRAMS

[76] Inventor: Stanislaus Strzelecki, 15 Hunts La., Brooklyn, N.Y. 11201

[21] Appl. No.: 320,540

[22] Filed: Nov. 12, 1981

[51] Int. Cl.[3] ..... B41J 1/52

[52] U.S. Cl. ..... 364/900; 400/110

[58] Field of Search ..... 364/200, 900; 400/110

[56] References Cited

U.S. PATENT DOCUMENTS 4,096,934 6/1978 Kirmser et al. ..... 400/110

4,294,550 10/1981 Wang ..... 400/110

*Primary Examiner*—Raulfe B. Zache

[57] ABSTRACT

A method of and a system for forming ideograms (or ideographic characters) including Chinese and Japanese Kanji, with associated alphabetic symbols for Roman, Hiragana, Chinese BoPoMoFo, Korean Hankul and the like. The system may be employed in the context of an ASCII (American Standard Code for Information Interchange) typewriter keyboard. Ideograms to be formed are identified from characteristic radical information, characteristic phonetic information, and characteristic colloquial sound information associated therewith.

7 Claims, 12 Drawing Figures

Fig. 5A: Flowchart for the selection of operational MODE by the central MPU under control of the keyboard.

Fig. 5B: Flowchart for operation in the Kanji ideographic mode

Fig. 5C: Flowchart for operation in the Kata Kana phonetic mode.

Fig. 5D: Flowchart for operation in the Hiragana phonetic mode.

METHOD OF AND APPARATUS FOR FORMING IDEOGRAMS

The present invention relates to systems for forming ideograms including Chinese and Japanese Kanji, with associated phonetic alphabets such as Roman, Katakana, Hiragana, Chinese BoPoMoFo, Korean Hankul and the like.

By way of background attention is called to U.S. patent application Ser. No. 211,390, filed Nov. 28, 1980 (Strzelecki et al.) now abandoned and its predecessor, U.S. Ser. No. 680,710, filed April 26, 1976, now abandoned as well as the prior art cited in each of the applications. In particular, U.S. Pat. No. 3,820,644 (Yeh) is of interest in terms of hardware to achieve electronic processing of data for storing, retrieving and reproducing Chinese Language characters.

Whereas English and other Western languages employ a Roman alphabet of twenty-six letters that are combined to form words, the Far East ideographic languages may employ as many as ten thousand ideographic characters or ideograms.

The Japanese, Chinese, and Korean written languages are primarily comprised of symbols which represent complete words or thoughts. These symbols are called ideographic characters (ideograms).

Oriental languages can be printed in either pictographic "KANJI" or alphabetic phonetic "KANA". "KANA" is the Japanese name for systems of scripts consisting of a small number of phonetic symbols which are often employed to represent ideograms phonetically. Typically, these Kana phonetic alphabets contain from forty to fifty characters. Different languages utilize different phonetic systems to express the common Kanji base. The Chinese use "BO PO MO FO" script; the Japanese use "KATAKANA" (for words foreign to the Japanese language) and "HIRAGANA" (for native Japanese words). The Koreans use "HANKUL". Finally, a variety of Roman alphabetic (Romaji) rendering systems are in wide use throughout various Eastern and Western communities.

Kanji is the more accurate, formal language of business, government, military and technology. The simple phonetic representations of Kana provide a means for representing the more complex Kanji symbols. The frequency of homonyms is such that Kana is inaccurate, with as many as seventy different meanings possible for a single phonetic representation of a Kanji character. Kana is frequently used in lieu of Kanji, or Kana may be interspersed within Kanji text to simplify content. There are about 10,000 Chinese written words (characters) in common use, although the language contains as many as 50,000. For printing, however, about 4000 Chinese characters and/or 2300 Japanese characters are sufficient to cover modern usage in newspapers and non-specialist journals. No prolonged explanation is needed to show that identifying any particular ideogram to be printed or otherwise formed presents a formidable task. In fact, dictionaries of ideograms are organized in different formats according to one or more of the following characteristics of ideograms: their radicals (recurring constituents of ideograms), strokes, and phonetic representations. The difficulty in organization and use of such dictionaries is evidence of the magnitude of the task of identifying a particular ideogram to be printed.

The invention provides a method and a system for forming ideograms, as for example, in Chinese and Japanese Kanji. Embodiments of the invention may also form alphabetic characters, such as Roman, Hiragana, Katakana, Chinese BoPoMoFo, Korean Hankul and the like. By "forming" a character is meant the entering and processing of information sufficient to identify the character for the purpose of printing the character, or displaying it, or otherwise using it for communications or other purposes. In a preferred embodiment, the system, which may employ a slightly modifed ASCII (American Standard Code For Information Interchange) typewriter keyboard, unambiguously identifies a proper ideogram to-be-formed, using characteristic radical information and, if needed, characteristic phonetic information and, if needed, characteristic colloquial information of the proper ideogram. A preferred embodiment may also include Roman characters on the keyboard, and form them in response to activation of a corresponding key.

In a preferred embodiment of the invention, relating specifically to the Japanese language, four modes of operation are presented. The four modes are the ideographic Kanji mode, and the alphabetic Roman, Hiragana, and Katakana modes. A comparable system is adaptable for Chinese (utilizing BoPoMoFo in lieu of Hiragana and Katakana), and for the Korean language (utilizing Hankul in lieu of Hiragana and Katakana).

The invention is hereinafter described with reference to the accompanying drawings in which.

Figure 1:
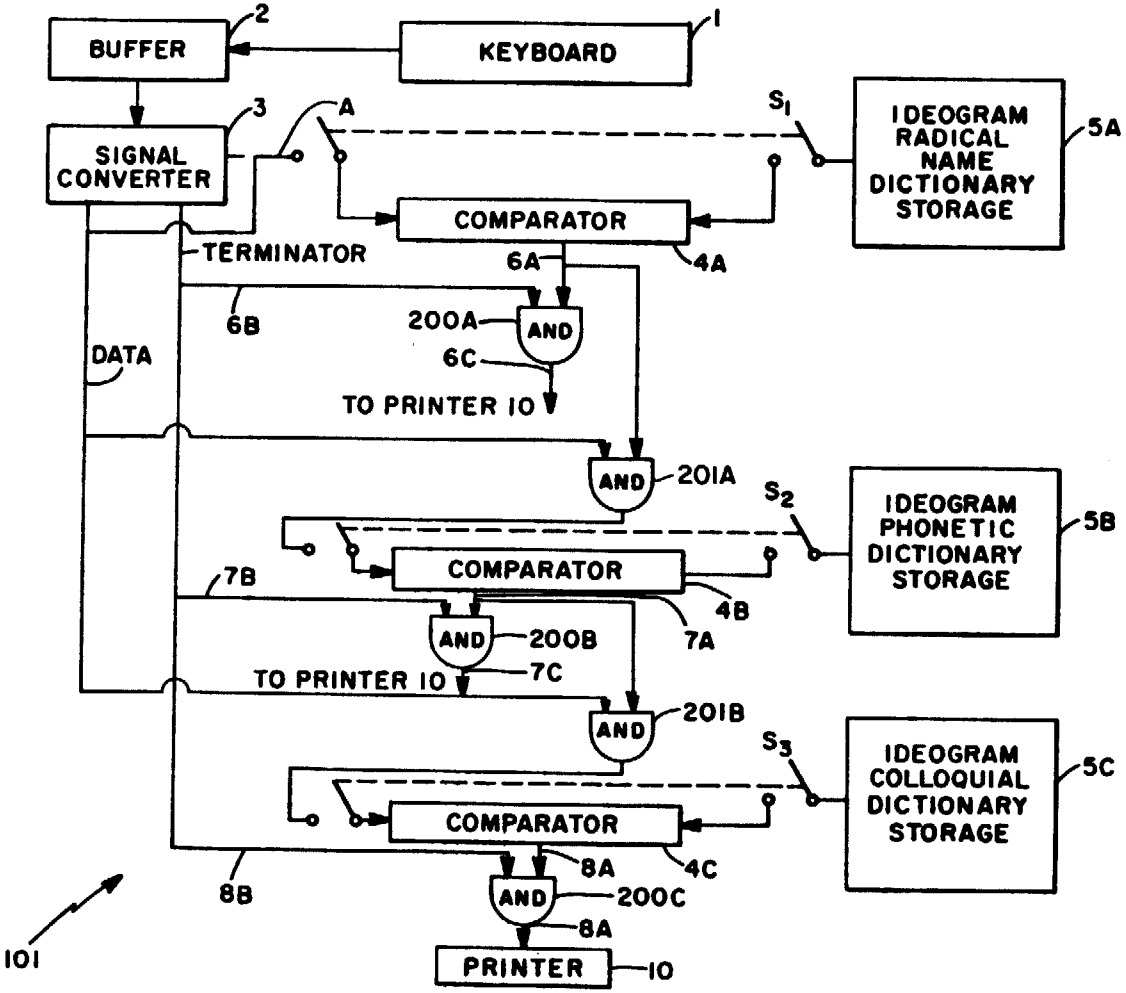
FIG. 1 is a simplified diagrammatic representation of a system for forming ideograms in accordance with the present invention.

FIG. 1 presents a simplified embodiment of the invention. The system 101 in FIG. 1 serves to form ideograms. The inventor has found that ideograms are identifiable from characteristic radical information, characteristic phonetic information, and characteristic colloquial information associated with the ideogram.

As is known by persons who understand Far Eastern languages, ideograms may be classified according to two hundred fourteen radical groups. A radical group is basic, but the radical is not pronounced in speech unless in a particular case the ideogram corresponds to the radical. The phonetic information is identified by sound which is called ON YOMI in Japanese and may be rendered in Kana in the Japanese language, BoPoMoFo in the Chinese language and Hankul in the Korean language; tone, if relevant (as in the case of Chinese), is also included in the phonetic information. The colloquial information, represents the colloquial sound information (KUN YOMI). In the discussion following, emphasis is placed on Japanese Kanji ideograms, but the system 101 of FIG. 1 can be expanded to produce ideograms in Chinese and alphabetic symbols such as Roman, Hiragana, Katakana, Chinese BoPoMoFo, Hankul and the like. Further, it should initially be noted that while three aspects of an ideogram may be employed in the identification process within the system 101, nevertheless, less than the three aspects may be needed to identify unambiguously any particular ideogram. Precisely, then, the system in the identification process identifies a particular ideogram serially by characteristic radical information and then, if needed to effect unambiguous identification of the ideogram, the characteristic phonetic information and then, if needed to effect unambiguous identification of the particular ideogram, the characteristic colloquial information.

Figure 2:
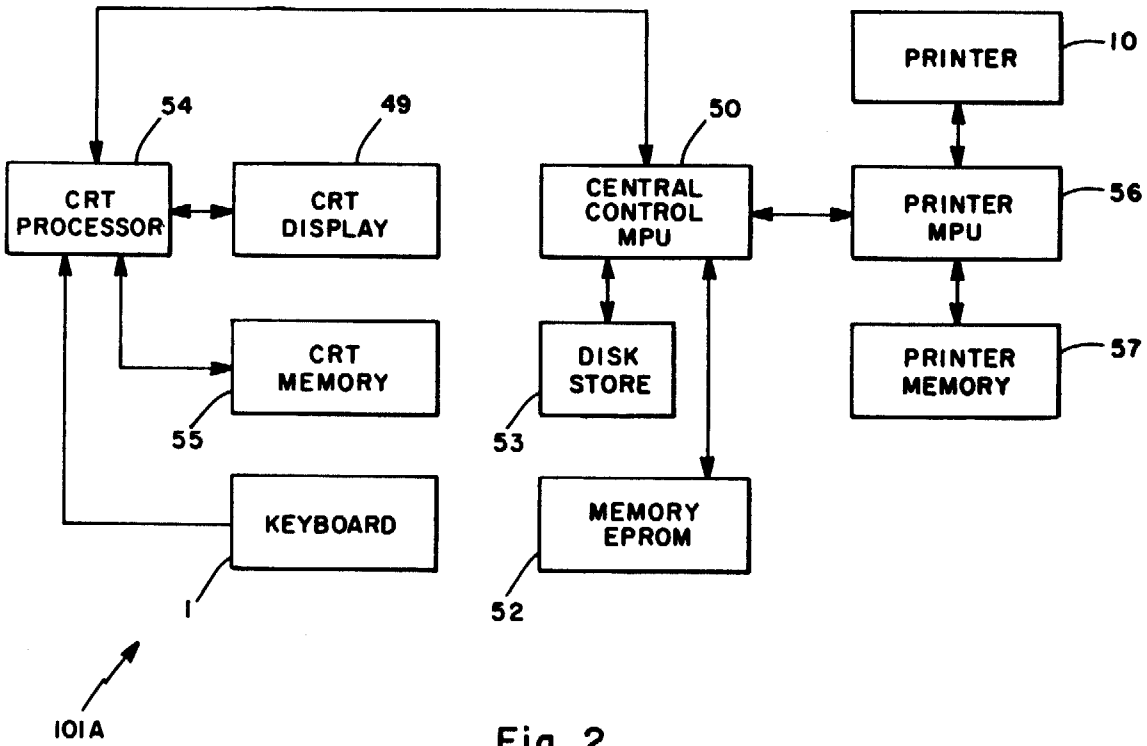
FIG. 2 is a block diagram of a preferred embodiment of a system in accordance with the present invention.

It is only when the particular ideogram is unambiguously identified that the printer shown at 10 in FIG. 1 is actuated and/or the CRT shown as 49 in FIG. 2 is utilized. Also, with respect to each ideogram to be produced, the operator may depress serially individual keys on the keyboard mechanism designated 1 to call successively for all three bundles of information, but all three are not always employed in the identification process.

Figure 3:
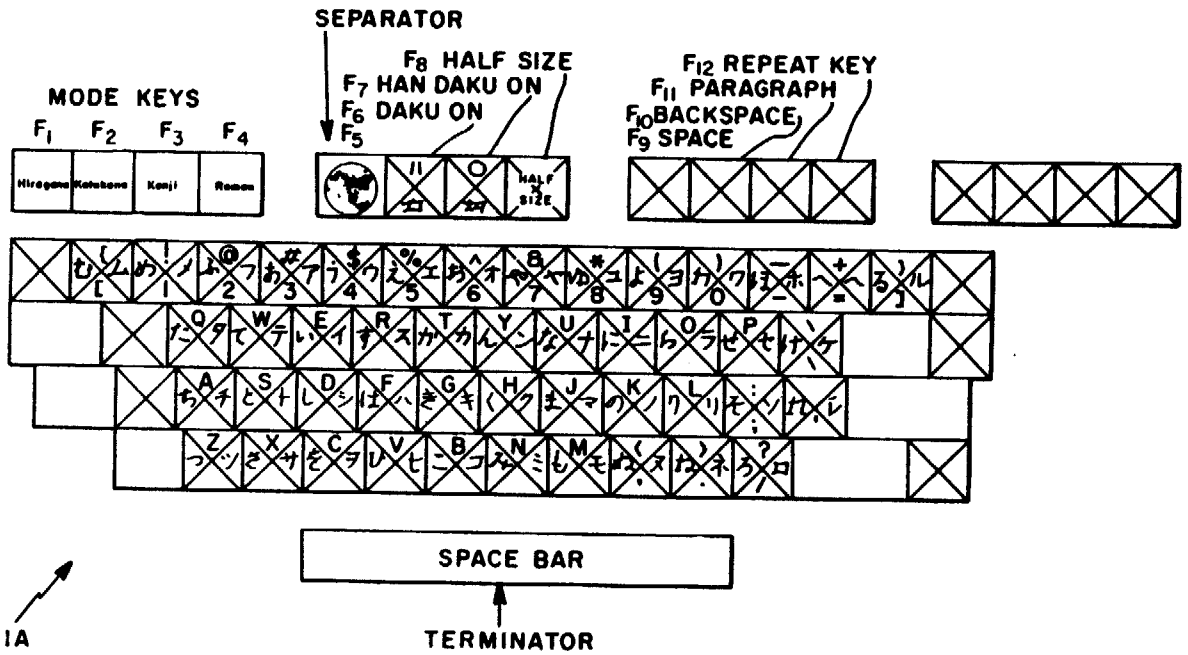
FIG. 3 is a top view of a slightly modified ASCII keyboard for use in accordance with a preferred embodiment of the invention.
Figure 4:
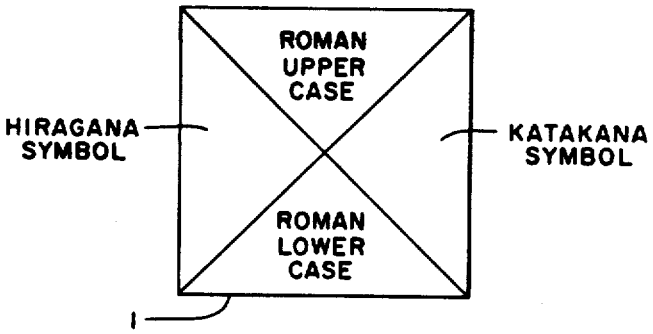
FIG. 4 is an enlarged top view of the keycap of one key of the keyboard of FIG. 3.

The keyboard in the system 101 of FIG. 1 may be in the fashion of the keyboard marked 1A in FIG. 3. Keys of the keyboard 1A in FIG. 3 may utilize, as shown in FIG. 4, a keycap 1 divided into four quadrants by two diagonals. The upper and lower quadrants generally contain symbols corresponding to the upper and lower cases on a standard English language ASCII keyboard. The left quadrant contains a Hiragana character. The right quadrant contains a Katakana symbol which is the phonetic equivalent of the Hiragana symbol contained in the left quadrant. The Kana symbols are placed on the keycaps in a manner similar to keys on a JIS (Japanese Industrial Standard) keyboard.

Turning now to FIG. 3, keys F1, F2, F3, and F4 provide respectively the Hiragana mode, the Katakana mode, the Kanji mode and the Roman mode of keyboard operation. The keyboard enters a particular mode when one of the mode keys F1–F4 corresponding to the mode has been depressed. The keyboard remains in that mode until one of the other mode keys F1–F4 is depressed, causing the newly selected mode to be entered. The Hiragana, Katakana, and Roman mode keys yield alphabetic symbols, in a manner readily understood, but the Kanji mode key does not, and it is to the Kanji mode that the present concepts are directed, although the other modes are important in the larger context in which the invention is placed.

When an operator sets the system into the ideographic Kanji mode by depressing the Kanji mode key F3 in FIG. 3, the system 101A in FIG. 2 accepts a series of key strokes which serially identify as many as three characteristics of the ideographic character to be displayed to the extent required for unique identification. The three characteristics are: (1) radical information, that is, the name of the radical; (2) phonetic information, that is, the sound of the character (ON YOMI); and (3) colloquial information, that is, the colloquial sound information (KUN YOMI). Once an ideogram is unambiguously identified by the procedure discussed above, a terminator signal is provided by depressing the space bar of the keyboard 1A in FIG. 3.

The operation of the system of FIG. 1 may now be explained. Buffer 2 in FIG. 1 operates to transmit signals from the keys of the keyboard 1 to a signal converter 3 and thence through switches S1, S2, and S3 to comparators 4A, 4B, and 4C respectively. The comparators 4A, 4B, and 4C receive through switches S1, S2, and S3, signals respectively from an ideogram radical name dictionary storage 5A, an ideogram phonetic dictionary storage 5B, and an ideogram colloquial sound differentiation dictionary storage 5C. In Kanji mode, a keystroke pattern from the keyboard relating to the name of the radical is stored in the buffer 2. When the keystroke pattern is released from the buffer 2 (when the separator key is depressed), ganged switch S1 is closed to provide to the comparator 4A inputs both of a data signal on a conductor A from the signal converter 3 and of a signal from the storage 5A that contains characteristic radical information. An output signal from the comparator 4A is sent along a conductor 6A to an AND-gate 200A; a further input to the AND-gate 200A comes along a conductor 6B from the signal converter 3. If an ideogram is unambiguously identified, the terminator signal appears on the conductor 6B, a message is sent to activate the printer 10, and the ideogram is printed. If no ideogram is so identified, a keystroke pattern relating to the phonetic content of the ideogram is then stored in buffer 2. Thereafter, upon depression of the separator key, data from signal converter 3 is gated through an AND-gate 201A and the ganged switch S2 is closed, providing a data input to the comparator 4B from the AND-gate 201A and a second input from the storage 5B that contains characteristic phonetic information. The output of comparator 4B passes along a conductor 7A to an AND-gate 200B, the other input to AND-gate 200B being over conductor 7B which carries a terminator signal if present. If an ideogram is unambiguously identified, a terminator signal causes AND-gate 200B to activate the printer 10. In the event that there is no identification, a keystroke pattern relating to the colloquial content of the ideogram is then stored in buffer 2. Thereafter, upon depression of the separator key, data from signal converter 3 is gated through an AND-gate 201B and the ganged switch S3 is closed, providing a data input to comparator 4C. Comparator 4C has its other input connected through S3 to the storage 5C that contains characteristic colloquial information. At this juncture, in most instances, an ideogram is identified, and an appropriate signal from the output of comparator 4C is passed along a conductor 8A to one input of an AND-gate 200C; the other input of AND-gate 200C is along 8B which carries the terminator signal from the converter 3. If an ideogram is now unambiguously identified, the AND-gate 200C passes an appropriate signal to activate printer 10. It is the experience of the present inventor that all but a handful of ideogram pairs can be unambiguously identified by a combination of radical, phonetic and colloquial information as discussed herein; these pairs are treated in a manner later discussed.

Figure 6:
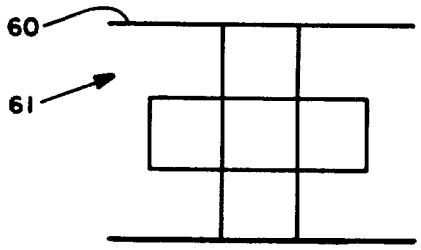
FIG. 6 is the ideogram for Asia.

As an example, let it be assumed that the Kanji symbol or ideogram for Asia shown at 61 in FIG. 6 is to be identified. The radical in the symbol is the horizontal line labelled 60 and is named "ee-chi". To identify the ideogram 61 in the apparatus 101A in FIG. 2, the first step is to depress the Kanji mode key F3 in FIG. 3; then the key having the Roman letter E on the keycap is depressed to represent the sound "ee"; next, the key having the Roman letter A on the keycap is depressed to represent the sound "chi". The radical, in this instance, did not unambiguously identify the ideogram 61 of FIG. 6; so the separator key labelled F5 in FIG. 3 is depressed to permit entry of the phonetic information. In this case the phonetic sound is "AH", which is indicated by depressing the key on the keyboard of FIG. 3 having the number 3 on the keycap. The ideogram for Asia has now been unambiguously identified, so the space bar is depressed to apply a terminator signal. If the ideogram had not been identified, the next step would be to depress again the separator key F5 to permit entry of colloquial information, and then to enter that information by successively depressing appropriate keys. Signals from the keyboard are used to give access to the appropriate store, representative of the character, which is stored on a disk store 53 or a memory EPROM 52 as shown in FIG. 2.

For example, in the case of Asia the letter E (for "ee") has an ASCII code of 69 and A (for "chi") has a code of 65. These two codes add to 134, which is the number that is searched through a table of radical data contained within the memory of the central control MPU 50 in FIG. 2. The radical data is used to isolate the tag for a graphics equivalent of the character on a disk store 53 or a memory EPROM 52 by the central MPU 50 in FIG. 2. The information in the storage units 5A, 5B, and 5C in FIG. 1 is contained in either or both of the elements 53 and 52 in FIG. 2.

The MPU 50 saves the first code entry, here ASCII 69, as well as the ASCII equivalent sum, here 134, and the number of keystrokes, here 2. If there is more than one phonetic keystroke, then the MPU 50 again saves the first entry keystroke, the ASCII equivalent sum, and the number of keystrokes. In this example ASCII 51 is saved as both a first entry keystroke and as the sum. There is one keystroke in the phonetic entry. If the colloquial information were called for, then again, the first entry, the sum, and the number of keystrokes would be saved. Once the terminator has been depressed, the MPU 50 sets out to identify the ideogram as identified. In the present example, the MPU 50 identifies the radical whose ASCII equivalent sum is 134; this radical will be in the block of dictionary data that is "ee-chi". If it should happen that two or more radicals were so identified, then the MPU 50 seeks that one of the radicals so identified having a first keystroke (or first ASCII number) of 69, and a total of two keystrokes. To summarize, for purposes of identification of each characteristic group, there are saved for each of radical, phonetic, and colloquial information: (1) the first keystroke; (2) the ASCII equivalent sum of keystrokes; and (3) the number of keystrokes.

Once a proper ideogram is identified, the MPU 50 in FIG. 2 sends an appropriate data to the CRT processor 54, which interacts with a CRT memory 55 to produce the identified ideogram on a CRT display 49. Eventually, a series of ideograms will be printed on a printer, again marked 10, upon appropriate messages from a printer MPU 56, which derives stored data from a printer memory 57. (The printer may be, for example, an ink-jet spray printer, a printer as shown in U.S. Pat. No. 4,159,882 which includes details of control circuitry, or other known device.)

When the three characteristic groups (i.e., radical, phonetic and colloquial) are used in accordance with the present teachings, as applied to the Toyo Kanji list of 1850 ideograms in common use (published by the Japanese Ministry of Education), all but a handful of ideogram-pairs will have been identified, but the particular ideogram of the pair will not be known. This impasse can be resolved by the operator's providing an input indicating that the proper ideogram is the first or the second ideogram of the pair, upon receipt of a signal on the CRT display 49 of FIG. 2 that such further indication is needed.

The System 101A of FIG. 2 allows an operator to access, display, edit, store, print and/or telecommunicate alphabetic information such as Roman, Chinese BoPoMoFo, Hiragana, Katakana, and Korean Hankul as well as the ideograms of Chinese and Japanese Kanji. Roman letters are called for by depressing the F4 key in FIG. 3. The upper case Roman letters are displayed in the upper quadrants of the keys. In the Hiragana, Katakana and Roman nodes of operation, each keystroke displays a single character which is identified by its ASCII code from information in the disk store 53 or the memory EPROM 52 of FIG. 2. (Of course, the use of ASCII code, although preferred in many embodiments of the invention, is only one configuration in which the keyboard may be utilized in the present invention. Any suitable code may be utilized, and identification by the three groups of information applicable to the Kanji mode may be accomplished by storing, for example, all keystrokes relating to the three groups, rather than ASCII sums, the initial stroke, and the number of strokes. Other storage configurations are also possible.)

Figure 5A:
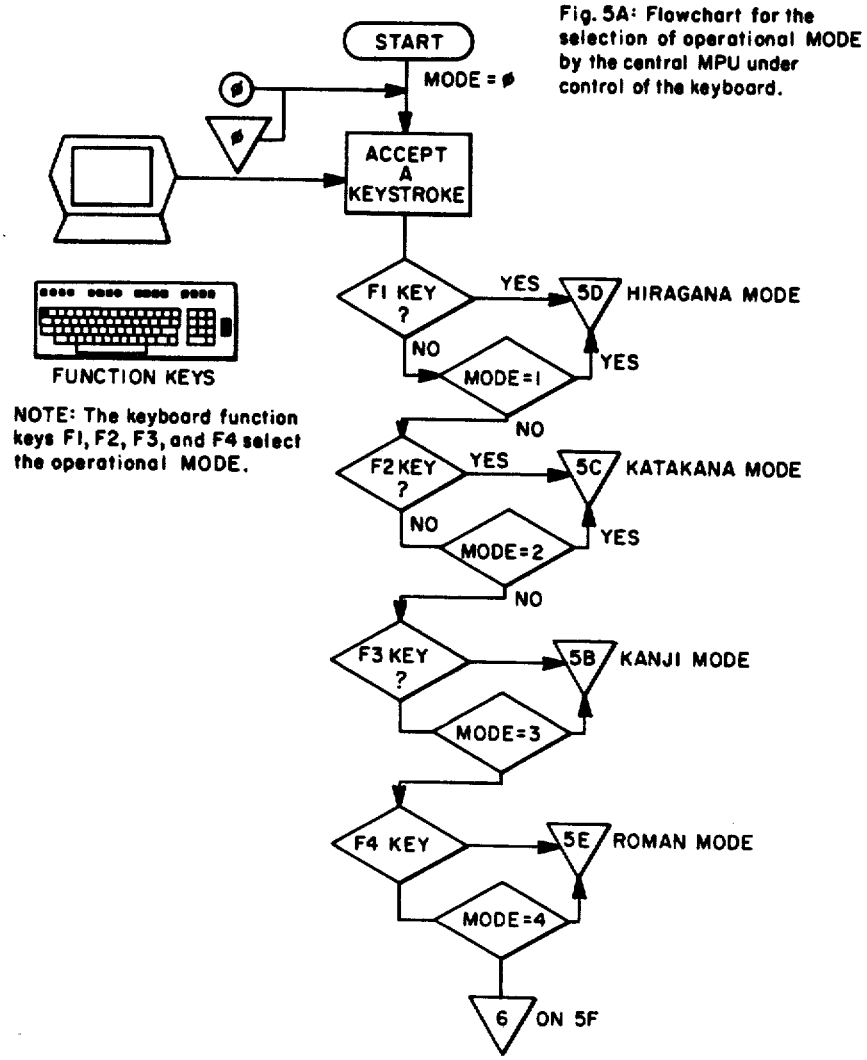
FIG. 5A shows a flow chart for the master controller or central MPU of FIG. 2 for selection of operational mode.
Figure 5B:
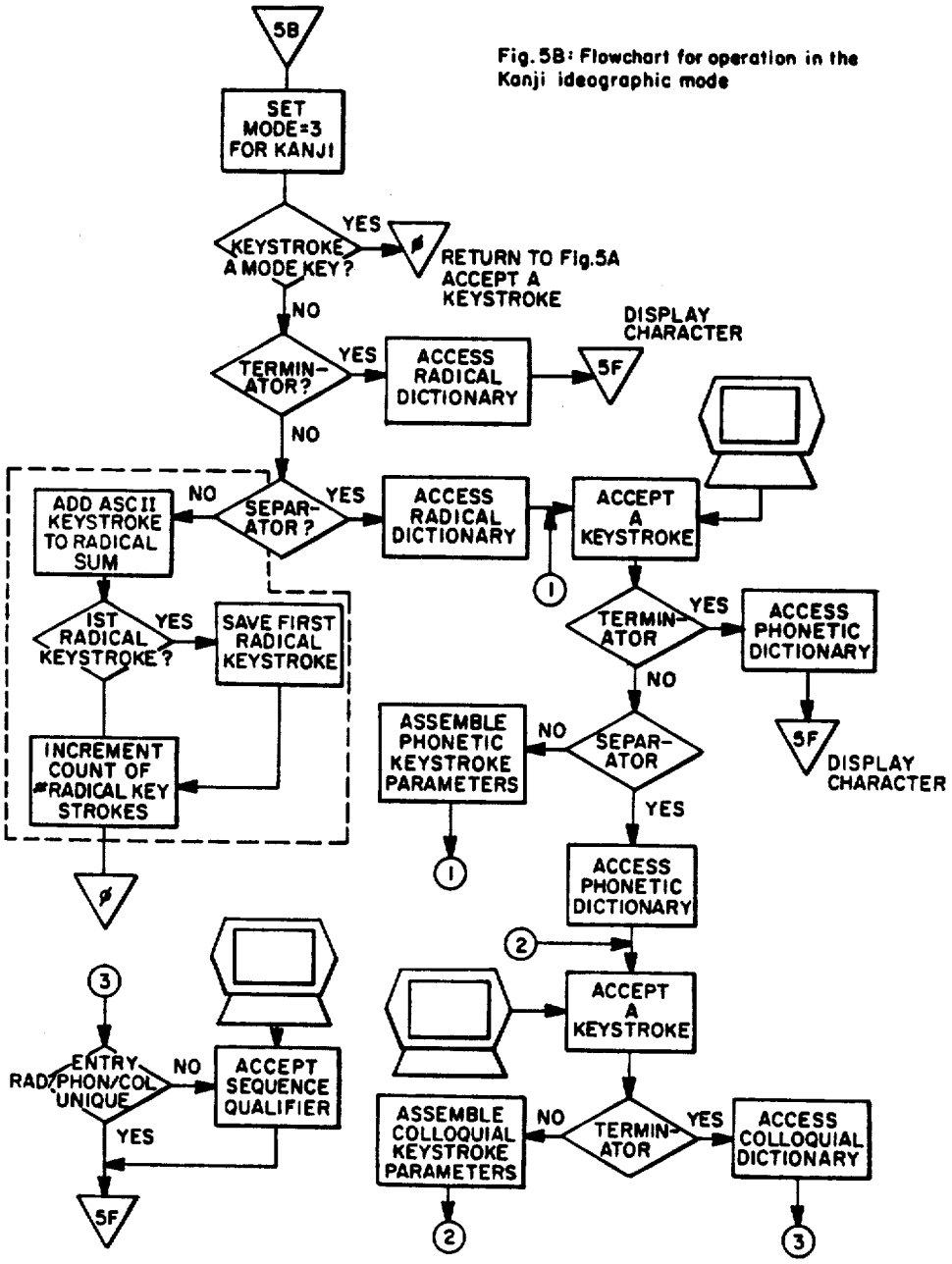
FIG. 5B is a flow chart for operation in the Kanji ideographic mode.
Figure 5C:
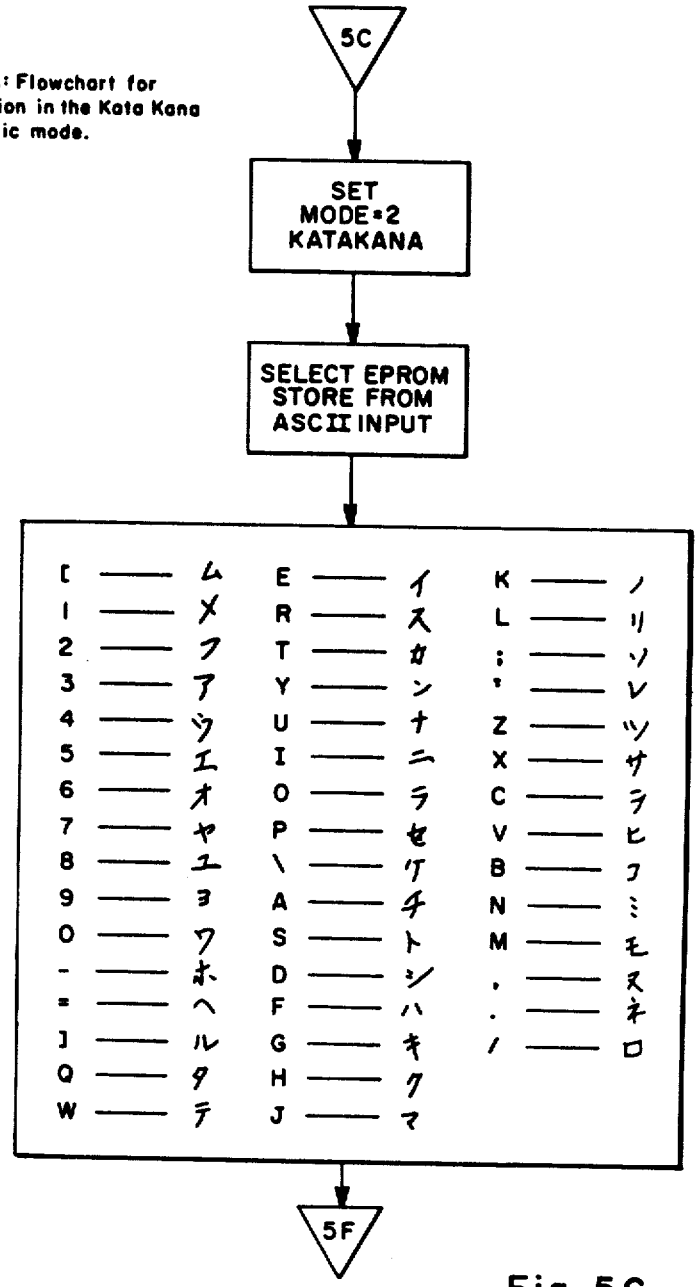
FIG. 5C is a flow chart for operation in the Katakana phonetic mode showing Roman ASCII code correspondences.
Figure 5D:
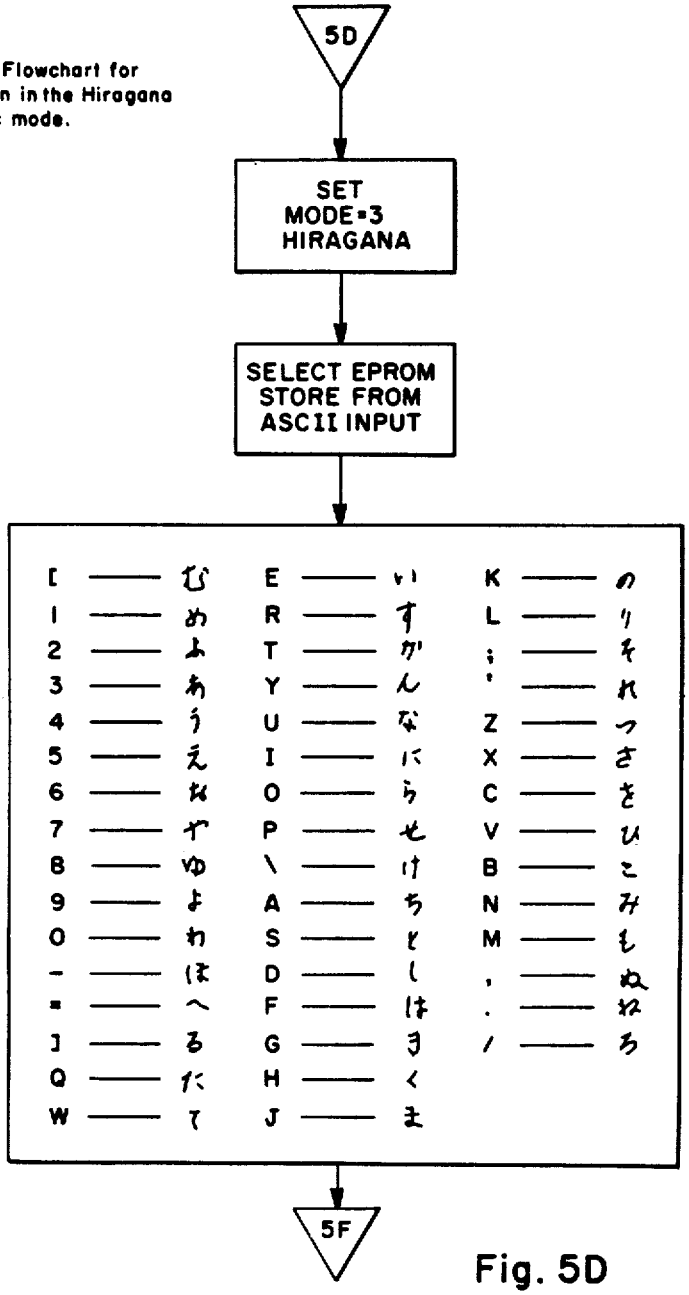
FIG. 5D is a flow chart for operation in the Hiragana phonetic mode showing Roman ASCII code correspondences.

When the operator sets the system into Hiragana mode, for example, by depressing the key F1 of FIG. 3, the system provides the images stored in the record graphics in a manner represented by the flow chart of FIG. 5D. Likewise, in the Katakana mode, accessed by depressing key F2 of FIG. 3, the system provides the images stored in the record graphics in a manner indicated by the flow chart of FIG. 5C.

Figure 7:
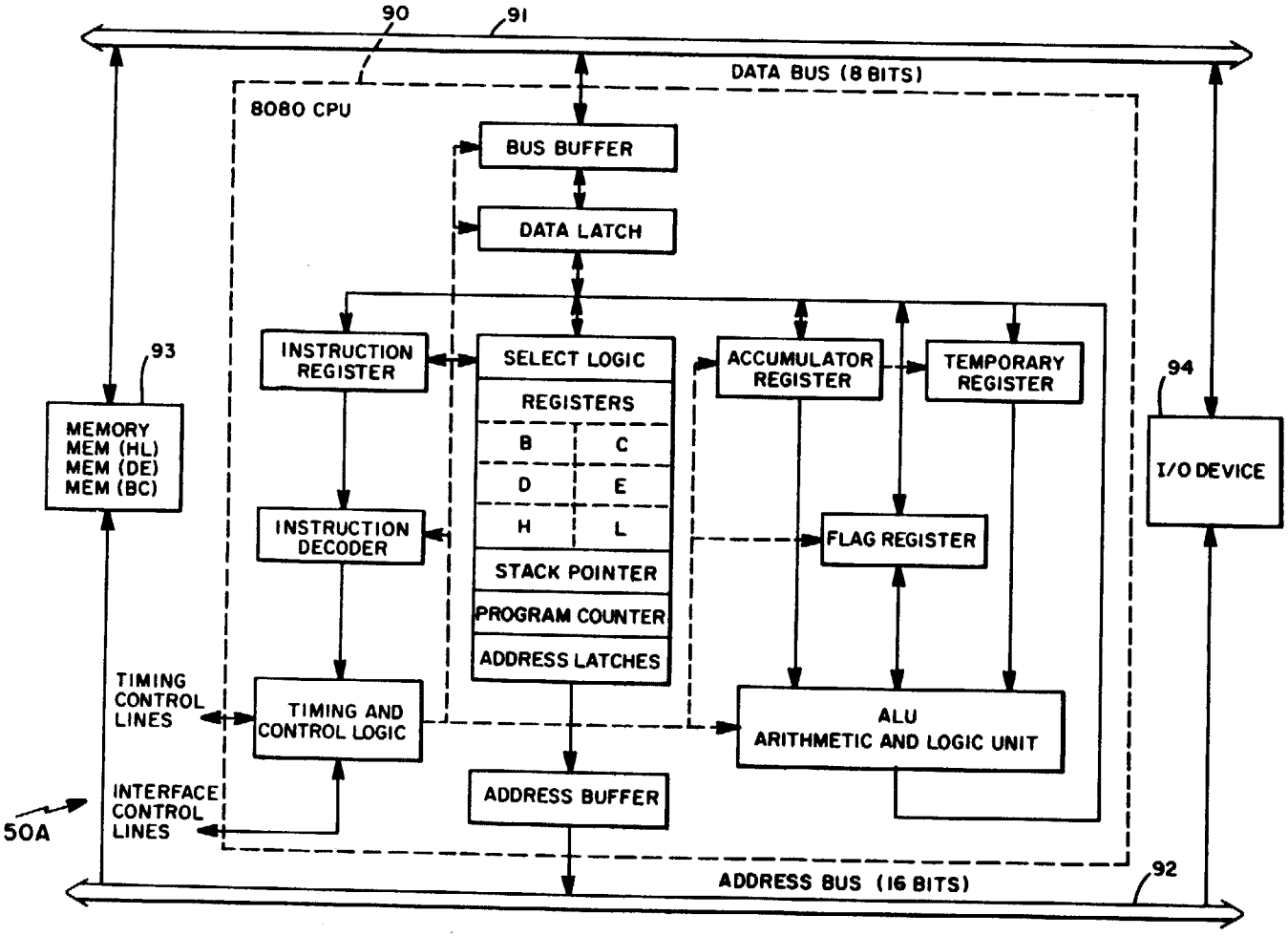
FIG. 7 shows in block-diagram form the architecture for an 8080 microprocessor for use in accordance with a preferred embodiment of the invention.

A system of the type shown diagrammatically in FIG. 2 may conveniently employ a type 8080 microprocessor, i.e., the N8080A of National Semiconductor Corporation, as chief part of MPU 50. The N8080A is well-documented processor whose architecture is shown as item 90 in FIG. 7. Interface with this microprocessor is accomplished by methods well-known in the prior art. See, for example, National INS8255 programmable interface as described in Publication No. 426305326-001A of December 1976.

The microprocessor 90 interacts along 8-bit and 16-bit data and address buses 91 and 92 respectively, with memory 93 and input/output (I/O) devices 94. The microprocessor includes an arithmetic/logic unit (ALU), seven 8-bit working registers (including an accumulator), a 16-bit program counter, a 16-bit stack pointer, and an 8-bit flag buffer. Other microprocessors or equivalent information-processing devices may also be utilized. The MPU 50 of FIG. 2 includes microprocessor 90 in FIG. 7 together with appropriate memory units 93 in FIG. 7.

In a preferred embodiment, system 101A of FIG. 2 performs the functions shown in the flow chart of FIG. 5A. The system 101A in FIG. 2 contains three microprocessors to share the processing tasks and improve overall operating efficiency. The CRT display processor 54 in FIG. 2 routes information from the keyboard to the central control MPU 50; controls the refresh of display information on the monitor display 49 from the CRT memory 55 in FIG. 2; and accepts control commands and data from the central control MPU 50. The central control MPU 50 in FIG. 2 executes the instructions from disk store 53 and memory EPROM 52. Additionally, the central control MPU 50 sends control commands and data to the CRT display processor 54 and to the printer MPU 56 in FIG. 2. The printer MPU 56 accepts control commands and data from the central control MPU 50. The printer MPU 56 controls the printing mechanisms, freeing up the central control MPU 50 for other processing and data input/output tasks.

Figures 5E, 5F:
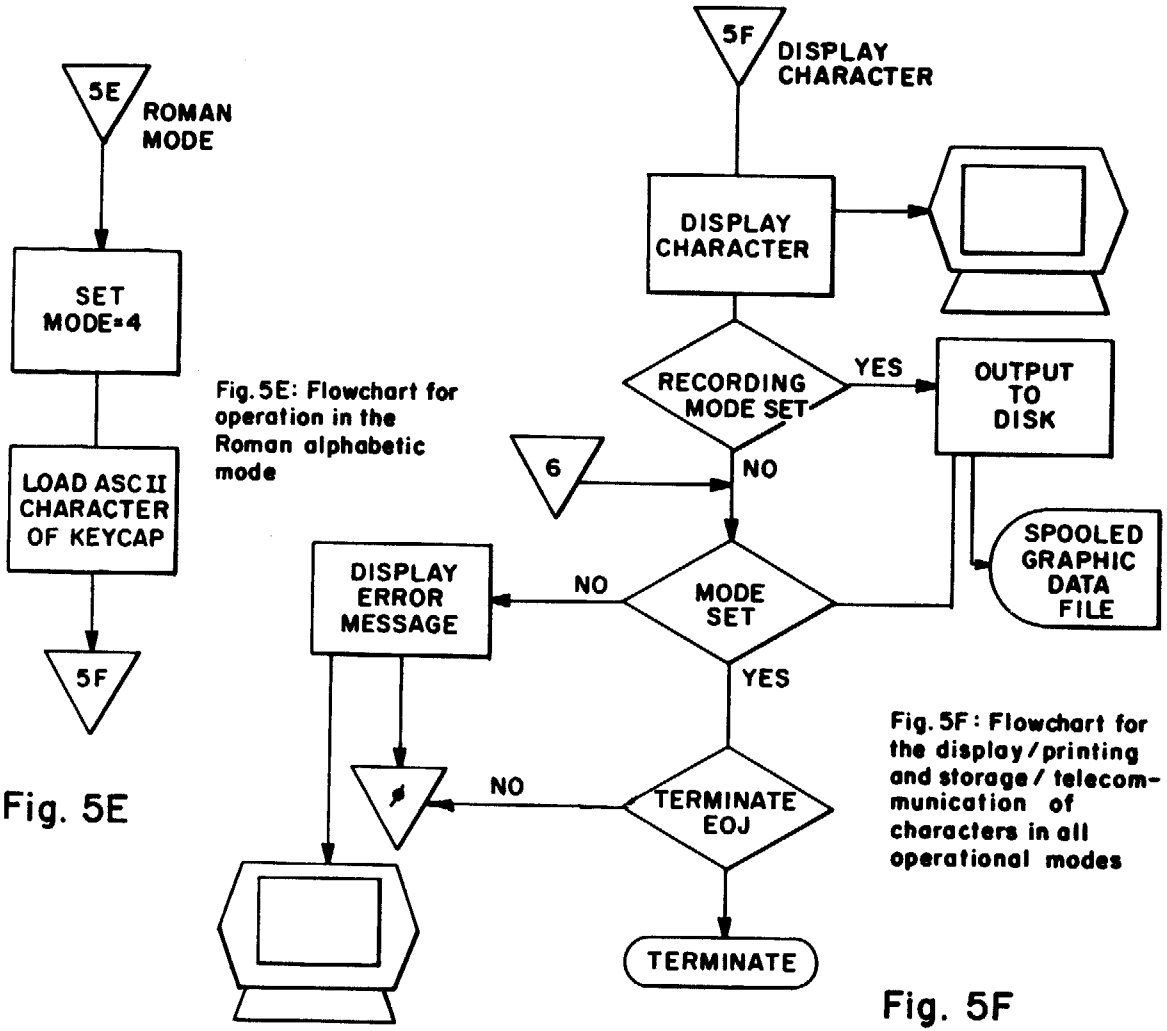
FIG. 5E is a flow chart for operation in the Roman alphabetic mode.
FIG. 5F is a flow chart for the display/printing and storage/telecommunication of characters in all operational modes.

Upon completion of the initial power up of the system and initial control sequence by MPU 50 of FIG. 2, control is turned over to the CRT processor 54. The system waits for a keyboard mode selection from the keyboard 1A of FIG. 3 as is shown in FIG. 5A. The function keys along the top of the ASCII keyboard section provide system functions for mode selection, character format and screen format information. Data entry of keystrokes to evoke character display can not begin until a mode has been selected. In the event a mode key has not been depressed and a mode is therefore not set, the system will request a mode selection. (See 6 of FIG. 5F.) As can be seen in FIG. 5A, in this embodiment there are four modes of operation for the system which may be selected by depressing the Hiragana, Katakana, Kanji, or Roman mode keys identified in FIG. 3 as F1, F2, F3 and F4 respectively. The Hiragana, Katakana, and Roman Mode keys select alphabetic modes of operation in which a single keystroke displays a single character. Standard ASCII keyboard codes generated to the central MPU via the Keyboard-/Display control unit display EPROM and/or disk-loaded alphabetic character sets. When the operator sets the system into the Hiragana Mode by depressing the Hiragana Key F1 in FIG. 3, the system provides graphic character patterns of the Hiragana Kana set which correspond to the images stored at the record locations indicated on the flowchart of FIG. 5D. When the operator sets the system into Katakana Mode by depressing the Katakana Key F2 in FIG. 3, the system provides graphic character patterns of the Katakana Kana set which correspond to the images stored at the record locations indicated on the flow chart FIG. 5C. When the operator sets the system into Roman Mode by depressing the Roman Key F4 in FIG. 3, the system provides graphic character patterns of the Roman alphabetic set which correspond to images stored as shown in FIG. 5E. In each of the three alphabetic/phonetic modes so far discussed, a single keystroke yields a single character on the display.

When the operator sets the system into Kanji Mode by depressing the Kanji Key F3 in FIG. 3, the system accepts a series of keystrokes which serially identify as many of three characteristics of the ideographic character to be displayed as are required, as follows:

(1) radical information: keyboard strokes which represent the name of the radical associated with the ideogram;

(2) phonetic information: keyboard strokes which represent the sound of the ideogram; and (3) colloquial information: keyboard strokes which represent colloquial sound of the ideogram.

Each of the three characteristics is a possible element needed to establish a one-to-one correspondence between a series of keyboard entries and an individual ideogram. Usually one or two characteristics are sufficient to identify the individual ideogram. In every case there is a hierarchy of radical, phonetic and colloquial characteristic information.

Therefore, referring to the flowchart FIG. 5B, a series of keystrokes are assembled in separate characteristic groups until a separator or a terminator is sensed. The area in FIG. 5B enclosed by a dashed line indicates in detail the manner in which parameters are assembled for each characteristic group during a keystroke entry. The parameters required for unique selection are the sum of the ASCII keystrokes, the first keystroke of a characteristic group, and the number of strokes within a characteristic group. Although the area in the dashed line applies specifically to radical keystrokes, a similar approach is taken for phonetic and colloquial information. In the event that the parameters for entry from the keyboard from a particular ideograph produces a set of duplicate labels which might resolve to a number of record locations, the central MPU 50 of FIG. 2 will present a number of exceptions under operator control from the keyboard by inclusion of a sequence number in the keyboard entry after the colloquial characteristic, or by the depression of a "repeat key" F12 in FIG. 3.

A series of comparator circuits search for the appropriate record in the graphics data base. Once the proper record has been selected the graphics information is routed to the display controller and generated on the display as shown in FIG. 5F. If the recording mode is set, the graphic information is spooled to a disk file for subsequent printing, display, or telecommunication. A test is made for termination EOJ. In the event another keyboard entry is required, a branch is made for return to the appropriate mode under the control of the central MPU as is shown in FIG. 5A.

Accordingly, while the invention has been described with particular reference to specific embodiments thereof, it will be understood that it maybe embodied in a variety of forms diverse from those shown and described without departing from the spirit and scope of the invention as defined by the following claims.

What is claimed is:

1. A system for forming ideograms, such system comprising:

a keyboard having a plurality of keys for entering characteristic radical information, phonetic information, and colloquial information pertaining to an ideogram;

storage means, for storing information for each ideogram including (1)(a) radical information, and, at least to the extent necessary for unambiguous identification of the ideogram when the radical information is known, (b) phonetic information and, at least to the extent necessary for unambiguous identification of the ideogram when the radical and phonetic information is known, (c) colloquial information, and (2) a graphic record identifier; and control means for obtaining from the storage means the graphic record identifier for a given ideogram in response to information entered on the keyboard.

2. A system according to claim 1, wherein (i) the depression of each key on the keyboard is identified by a numerical code; and (ii) the control means includes means for storing, with respect each of the radical information, phonetic information, and colloquial information, (a) the code of the initial keystroke, (b) the number of keystrokes, and (c) the sum of the codes of the keystrokes.

3. A system according to claim 1, wherein the keyboard includes a plurality of keys, each of which may identify a Hiragana, Katakana, or Roman character in accordance with a mode selected by the keyboard.

4. A system according to claim 1, wherein the keyboard includes a plurality of keys, each of which may identify a Chinese BoPoMoFo or Roman character in accordance with a mode selected by the keyboard.

5. A system according to claim 1, wherein the keyboard includes a plurality of keys, each of which may identify a Korean Hankul or Roman character in accordance with a mode selected by the keyboard.

6. A system according to claim 3, wherein a plurality of keys have keycaps, each keycap being divided into 4 quadrants in which are indicated the respective Hiragana, Katakana, and Roman characters identified by the key on which the keycap is placed.

7. A method of forming ideograms, such method comprising:

A. storing information for each ideogram including (1) (a) radical information, and, at least to the extent necessary for unambiguous identification of the ideogram when the radical information is known, (b) phonetic information, and, at least to the extent necessary for unambiguous identification when the radical and phonetic information is known, (c) colloquial information, and (2) a graphic record identifier;

B. obtaining, with respect to an ideogram to be formed, (i) radical information, and, at least to the extent necessary for unambiguous identification of the ideogram when the radical information is known, (ii) phonetic information, and, at least to the extent necessary for unambiguous identification of the ideogram when the radical and phonetic information is known, (iii) colloquial information; and C. finding, among the information stored in step A, the graphic record identifier applicable to the information obtained in step B.

* * * * *